US008816779B2

(12) United States Patent
Lecomte et al.

(10) Patent No.: US 8,816,779 B2
(45) **Date of Patent: *Aug. 26, 2014**

(54) DEVICE FOR AN ATOMIC CLOCK

(75) Inventors: Steve Lecomte, Bernex (CH); Jacques Haesler, Murten (CH)

(73) Assignee: CSEM Centre Suisse d'Electronique et de Microtechnique S.A., Neuchatel (CH)

( * ) Notice: Subject to any disclaimer, the term of this patent is extended or adjusted under 35 U.S.C. 154(b) by 0 days.

This patent is subject to a terminal disclaimer.

(21) Appl. No.: 13/394,012

(22) PCT Filed: Sep. 1, 2010

(86) PCT No.: PCT/CH2010/000215

§ 371 (c)(1),
(2), (4) Date: Jun. 26, 2012

(87) PCT Pub. No.: WO2011/026252

PCT Pub. Date: Mar. 10, 2011

(65) Prior Publication Data

US 2012/0256696 A1 Oct. 11, 2012

(30) Foreign Application Priority Data

Sep. 4, 2009 (EP) ..... 09405149
Jul. 9, 2010 (CH) ..... 1122/10

(51) Int. Cl.
*H03L 7/26* (2006.01)

(52) U.S. Cl.
USPC ..... 331/3; 331/94.1; 368/156; 324/304

(58) Field of Classification Search
CPC ..... G04F 5/145; G04F 5/14; H03L 7/26
USPC ..... 331/3, 94.1; 324/304; 368/156
See application file for complete search history.

(56) References Cited

U.S. PATENT DOCUMENTS 4,764,731 A 8/1988 Salour
5,340,986 A 8/1994 Wong (Continued)

FOREIGN PATENT DOCUMENTS

EP 0 550 240 A1 7/1993
EP 0550240 A1 7/1993

OTHER PUBLICATIONS

International Search Report of PCT/CH2010/000215, mailing date of Jan. 20, 2011.

(Continued)

*Primary Examiner* — Arnold Kinkead
(74) *Attorney, Agent, or Firm* — Westerman, Hattori, Daniels & Adrian, LLP

(57) ABSTRACT

A device for an atomic clock, including: a laser source (102) generating a laser beam; a quarter-wave plate (105) modifying the linear polarization of the laser beam into a circular polarization and vice versa; a gas cell (106) placed on the laser beam having a circular polarization; a mirror (107) sending the laser beam back toward the gas cell; a first photodetector (108*a*); means (103, 101*a*, 107) for diverting the reflected beam of the laser source (102), and a second photodetector (109) placed behind the mirror (107), the mirror being semitransparent and allowing a portion of the laser beam to pass therethrough, the second photodetector (109) being used for controlling the optical frequency of the laser and/or for controlling the temperature of the cell (106).

18 Claims, 6 Drawing Sheets

(56) References Cited

U.S. PATENT DOCUMENTS

| | | | | |
|---|---|---|---|---|
| 5,751,193 | A | 5/1998 | Nakajima et al. | |
| 6,222,424 | B1 | 4/2001 | Janssen et al. | |
| 6,525,825 | B2 | 2/2003 | de Groot et al. | |
| 7,064,835 | B2 | 6/2006 | Riley, Jr. et al. | |
| 7,102,451 | B2 | 9/2006 | Happer et al. | |
| 7,323,941 | B1 * | 1/2008 | Happer et al. | 331/3 |
| 7,619,485 | B2 | 11/2009 | DeNatale et al. | |
| 7,982,944 | B2 | 7/2011 | Kippenberg et al. | |
| 8,237,514 | B2 | 8/2012 | Aoyama et al. | |
| 8,242,851 | B2 * | 8/2012 | Youngner et al. | 331/94.1 |
| 8,379,206 | B2 * | 2/2013 | Kachanov et al. | 356/436 |
| 8,432,162 | B2 | 4/2013 | Nagasaka | |
| 2005/0264818 | A1 | 12/2005 | Gollier | |
| 2007/0139128 | A1 | 6/2007 | Koyama | |
| 2007/0146085 | A1 | 6/2007 | Koyama | |
| 2009/0128820 | A1 | 5/2009 | Nomura | |
| 2009/0180357 | A1 | 7/2009 | Chen | |
| 2009/0302957 | A1 | 12/2009 | Levi et al. | |
| 2012/0212298 | A1 * | 8/2012 | Lecomte et al. | 331/94.1 |
| 2013/0003766 | A1 * | 1/2013 | Savchenkov et al. | 372/38.01 |

OTHER PUBLICATIONS

S. Knappe, "MEMS Atomic Clocks", Comprehensive Microsystems, Elsevier B.V., vol. 3, pp. 571-612 (2008).

International Preliminary Report on Patentability (Form PCT/IB/373) of International Application No. PCT/CH2010/000215, dated Mar. 6, 2012 with Forms PCT/ISA/237.

International Search Report of PCT/CH2010/000214, mailing date Jan. 27, 2011. Cited by Applicant in co-pending U.S. Appl. No. 13/393,996.

Bendelli et al. "Optical Isolators for telecommunications: review and current trends," European Transactions on Telecommunications and Related Technologies, vol. 3, No. 4 (1992). Cited by Applicant in co-pending U.S. Appl. No. 13/393,996 as listed in ISR of PCT/CH2010/000214.

S. Knappe, "MEMS atomic clocks," Comprehensive Microsystems, Elsevier B.V., vol. 3, pp. 571-612 (2008). Cited by Applicant in co-pending U.S. Appl. No. 13/393,996 as listed in ISR of PCT/CH2010/000214. Already cited in IDS filed Mar. 2, 2012 as listed in ISR of PCT/CH2010/000215.

International Preliminary Report on Patentability (Form PCT/ISA/237), of International Application No. PCT/CH2010/000214, date of mailing Jan. 27, 2011. Cited by Applicant in co-pending U.S. Appl. No. 13/393,996.

U.S. Office Action dated Sep. 9, 2013 mailed in co-pending U.S. Appl. No. 13/393,996.

Notice of Allowance and Fee(s) Due dated May 7, 2014, issued in U.S. Appl. No. 13/393,996 (8 pages).

* cited by examiner

DEVICE FOR AN ATOMIC CLOCK

INTRODUCTION

The present invention relates to the field of atomic clocks.

STATE OF THE ART

Miniature atomic clocks (with a volume of one $cm^3$ or less), with low electrical consumption (less than a Watt) and which allow portable applications, are devices that have been made possible by the combination of the physical CPT (coherent population trapping) or Raman principles with an atomic clock architecture based on a gas absorption cell. These two physical principles do not require any microwave cavity to interrogate the reference atoms (typically rubidium or cesium) and thus eliminate the volume constraint associated with the conventional cell-type atomic clocks. The physical part of the clock, which consists of the light source, the optical elements, the gas cell, the photodetector and all the functions such as heating and magnetic field generation, will be covered by the following deliberations. The implementation of technologies such as vertical-cavity surface-emitting semiconductor-type lasers (VCSEL), the techniques of microfabrication for the gas cells and of vacuum encapsulation have made it possible to massively reduce the volume and the electrical consumption of these atomic clocks. The VCSEL lasers offer the possibility of combining the optical pumping function and the microwave interrogation of the reference atoms. This type of laser offers the following advantages: modulation of the injection current possible up to several gigahertz, low consumption, wavelength compatible with the standard reference atoms (rubidium or cesium), excellent service life, operation at high temperature, low cost and ideally suited optical power. The silicon microstructuring technologies coupled with the methods for bonding/welding a glass substrate (typically pyrex or quartz) onto a silicon substrate make it possible to produce gas cells with dimensions much smaller than is possible to produce with the traditional glass tube blowing and forming technique. The reduction of the dimensions of the gas cell is also accompanied by a reduction in the consumption needed to heat the gas cell.

Different arrangements of the physical part of such a clock have been produced. Most of the arrangements are based on a single passage of the laser beam through the cell (see S. Knappe, MEMS atomic clocks, Book chapter in Comprehensive Microsystems, vol. 3, p. 571 (2008), Ed. Elsevier), others exploit gas cells comprising mirrors inside the cell or else allowing a double passage of the laser beam through the cell (see documents U.S. Pat. No. 7,064,835 and EP0550240). The arrangements with double passage of the light through the cell have the advantage of doubling the effective optical length of the cell and therefore improving the performance levels of the atomic clock (in terms of electrical consumption and/or of frequency stability). However, these double-passage arrangements have not been implemented for reasons of instability of the device and in particular because of disturbances to the laser evoked by the light reflected back by the mirrors onto the laser.

The documents U.S. Pat. No. 7,064,835 (Symmetricom), U.S. Pat. No. 5,340,986 (Wong) and US2009/128820 (Seiko, FIG. 6) describe the use of a splitter element in order to direct the reflected beam toward the photodetector. The light emitted by the laser is linearly polarized, converted into circular polarization by a quarter-wave plate before passage in the cell, reflection on the mirror, second passage in the cell, and detection on a photodetector.

The configurations described above present drawbacks for producing a CPT oscillator. In practice, a detector can be placed before the passage of the light in the cell and another after the double passage in the cell, but no photodetector can be positioned after a single passage of the light in the cell. This additional detector makes it possible to obtain an additional signal to that of the detector placed after the double passage. This additional signal is useful for measuring and controlling clock parameters such as the temperature of the cell or the frequency of the laser source for example. Furthermore, the configurations described above have little application in a configuration of a Raman oscillator because the control of the frequency of the laser source is performed by the same detector handling the detection of the laser beam returned from the cell.

BRIEF DESCRIPTION OF THE INVENTION

The present invention therefore aims to propose a device for an atomic clock allowing for a double passage in the cell and which allows for easy control of the laser frequency, both for a CPT oscillator and for a Raman oscillator.

This aim is achieved by a device for an atomic clock comprising a laser source generating a laser beam, a quarter-wave plate modifying the linear polarization of the laser beam into a circular polarization and vice versa, a gas cell placed on the laser beam with circular polarization, a mirror sending the laser beam back toward the gas cell, a first photodetector, as well as means for preventing the reflected beam from reaching the laser source, characterized in that it comprises a second photodetector, placed behind the mirror, said mirror being semitransparent and allowing a portion of the laser beam to pass, said second photodetector being used to control the optical frequency of the laser and/or to control the temperature of the cell.

BRIEF DESCRIPTION OF THE FIGURES

The invention will be better understood from the following detailed description while referring to the appended drawings in which:

FIG. 1(*b*): is a schematic diagram of the Raman oscillator

DETAILED DESCRIPTION

Figure 1A:
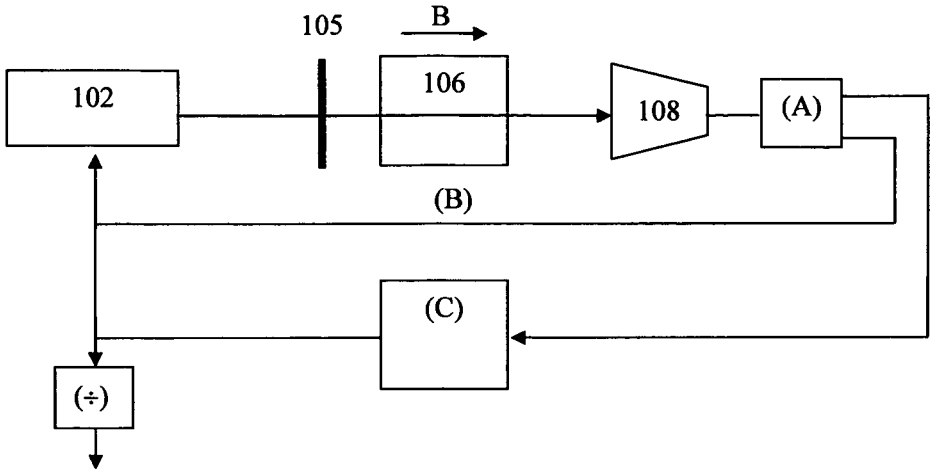
FIG. 1(*a*): is a schematic diagram of the CPT oscillator

FIG. 1*a* is a schematic illustration of the CPT atomic clock comprising a laser diode 102, a λ/4 plate (or quarter-wave plate) 105, a gas cell (atomic) 106, an optional magnetic field B, a first photodetector 108, control electronics (A) and a microwave oscillator (C). The laser beam that has passed through the gas cell 106 is picked up by the first photodetector 108 and is used by the control electronics to stabilize the frequency of the laser (B) and the frequency of the microwave oscillator (C). A microwave divider (÷) generates the reference frequency requested by the end user of the device.

Figure 1B:
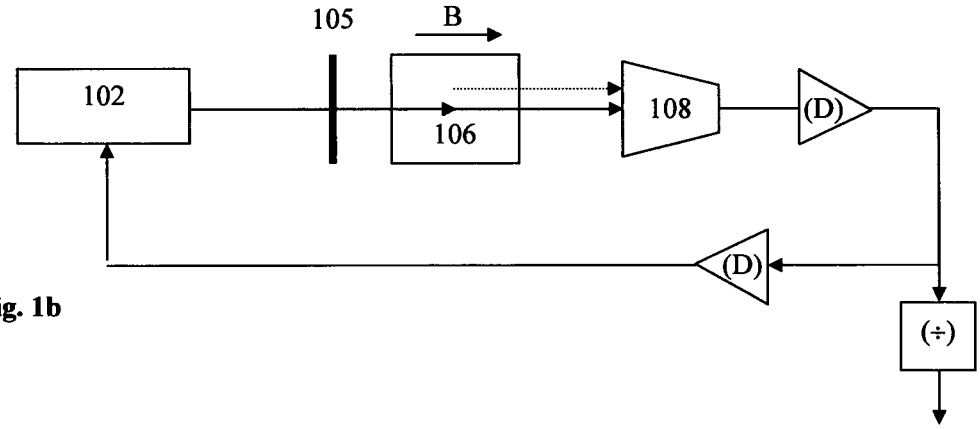

FIG. 1*b* is a schematic illustration of a Raman oscillator in closed loop mode comprising a laser diode 102, a λ/4 plate (or quarter-wave plate) 105, a gas cell (atomic) 106, an optional magnetic field B, a first photodetector 108, a microwave frequency divider (÷), and a radiofrequency (RF) amplifier (D). The laser beam emitted by the laser diode 102 undergoes, in the gas cell 106, a light-atom interaction which generates an additional beam, called Raman beam. The two light beams are picked up by the first photodetector 108 and the frequency beat of these two beams is amplified (D) and used as feedback on the laser to close the micro-wave loop of the Raman oscillator.

Figure 2:
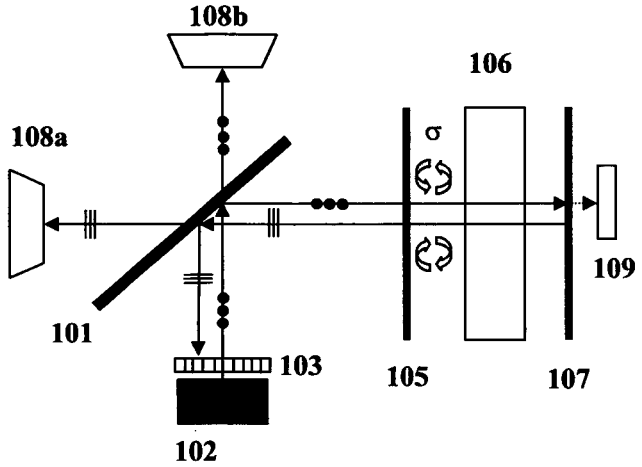
FIG. 2: is a first embodiment with double passage with polarizing filter
Figure 3:
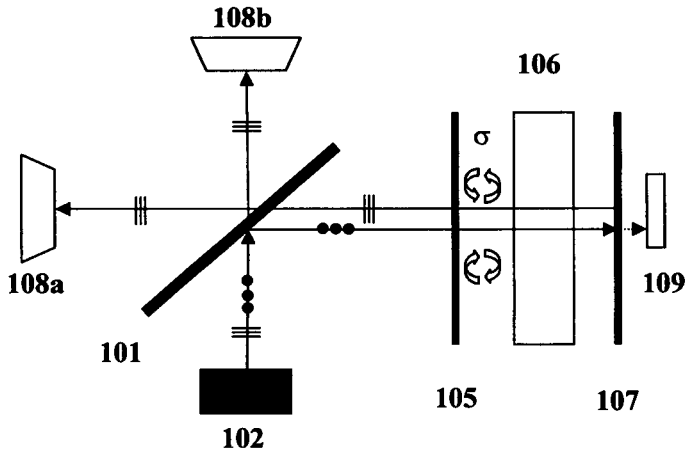
FIG. 3: is a second embodiment with double passage with polarizing cube
Figure 4:
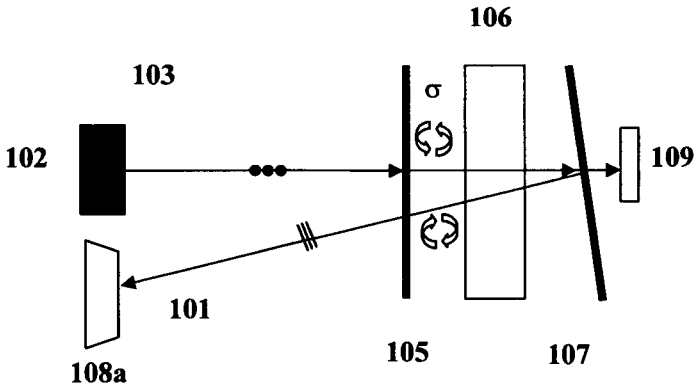
FIG. 4: is a third embodiment with double passage with oblique mirror

FIGS. 2, 3 and 4 illustrate 3 different embodiments making it possible simultaneously to produce the double passage in the gas cell and the frequency control as well as the protection of the laser source from the reflections. The common point of these different embodiments is the presence of a semitransparent mirror 107 which allows the passage of a portion of the laser beam having passed through the gas cell in order to reach a photodetector 109 used to control the optical frequency of the laser and/or to control the temperature of the cell.

These three embodiments differ in the means used to direct the beam toward the cell and the photodetectors, and in the means used to prevent the beam reflected by the mirror from disturbing the laser source.

FIG. 2 illustrates the first embodiment of the invention. The laser source 102 produces a linearly polarized laser beam which is directed toward the polarizer 103, the transmission axis of which is oriented in such a way as to allow the laser beam to pass, then toward the splitter 101 whose splitting percentage is predefined. A portion of the beam is thus transmitted toward the optional photodetector 108*b*. The splitter reflects the other portion of the beam toward a quarter-wave plate 105. The linear polarization is denoted "P" for the portion parallel to the transmission axis of the polarizer (transmitted portion) and "S" for the portion perpendicular to the transmission axis of the polarizer (portion absorbed by the polarizer). In the figures, the portion "P" is symbolized by full circles and the portion "S" by lines. The role of the plate 105 is to change the linear polarization of the laser beam into a circular polarization and this plate is oriented relative to the polarizer so as to generate a circular polarization. In practice, the interaction between the light and the atoms of the gas cell 106 is optimum when it is produced with a beam of circular polarization. A portion of the beam leaving the gas cell 106 is then reflected by a mirror 107, which reverses the direction of its circular polarization, and thus passes a second time through the gas cell 106. On leaving the gas cell 106, the beam reaches the quarter-wave plate 105. Depending on the predefined splitting percentage of the splitter 101, this beam is then partly transmitted and reaches the photodetector 108*a*. Another portion of this beam is deflected by the splitter 101 and is greatly attenuated by the polarizer 103 because its polarization is perpendicular to that of the transmission axis of the polarizer 103, the laser source 102 thus being protected from the back-reflections. A small portion of the beam having passed through the gas cell 106 is transmitted by the mirror 107 and picked up by the photodetector 109.

FIG. 3 illustrates the second embodiment of the invention. It differs from the first embodiment by the use of a splitter 101 which reflects the beam according to a first polarization and allows the beam to pass according to a second polarization. Thus, the beam leaving the laser source 102 is split according to its polarization and the same principle is applied to the reflected beam. It is thus not necessary to place a polarizer between the splitter 101 and the laser source because the reflected beam is entirely transmitted toward the photodetector 108*a*. The linear polarization is denoted "P" for the portion parallel to the polarization axis of the splitter (portion transmitted in the right-angle configuration of FIG. 3) and "S" for the portion perpendicular to the polarization axis of the splitter (portion deflected by 90°). In FIG. 3, the portion "P" is symbolized by lines and the portion "S" by full circles. A small portion of the beam having passed through the gas cell 106 is transmitted by the mirror 107 and picked up by the photodetector 109.

FIG. 4 illustrates the third embodiment of the invention. In this figure, the deflection of the laser beam is ensured by the semitransparent mirror 107 which is arranged according to an angle that is not perpendicular to the axis of the laser beam. Thus, the reflected beam does not reach the laser source 102 but is directed directly on the photodetector 108*a*. In the case of the Raman oscillator, it is advantageous for the mirror 107 to be of concave form, the concave form being intended to focus the reflected light beam on the photodetector 108*a*. A small portion of the beam having passed through the gas cell 106 is transmitted by the mirror 107 and picked up by the photodetector 109. This concave form of the mirror can be implemented on the embodiments of FIGS. 2 and 3, providing the advantages described above.

Figure 5:
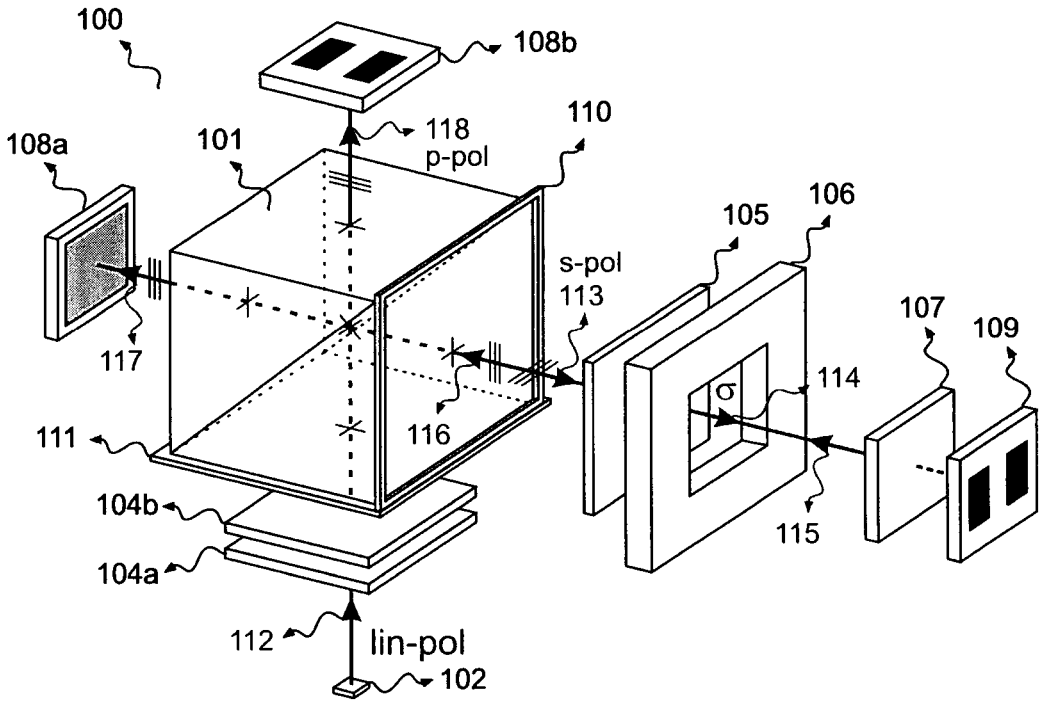
FIG. 5: is an exploded schematic presentation of the device of the invention based on the second embodiment with double passage and a right-angle geometry

A more complete exemplary embodiment corresponding to the second embodiment is illustrated in FIG. 5. The splitter 101 is implemented in the form of a polarizing beam splitter cube (PBSC). This cube makes it possible to implement a double passage through the gas cell 106 which doubles the interaction between the light from the laser and the atomic medium. A better atomic signal is obtained, and thus a better stability of the atomic clock frequency.

In FIG. 5, the optical assembly is based on a miniature splitter cube 101 whose sides are preferably less than or equal to 1 mm, the cube 101 serving as splitter. According to a standard embodiment, the volume of the cube is typically 1 $mm^3$. The light beam from the laser diode 102 arrives on one of the sides of the cube 101. According to one embodiment, the laser diode is of vertical-cavity surface-emitting semiconductor type (VCSEL) emitting a 795 nm divergent light beam.

In other embodiments, other types of laser diodes having wavelengths typically varying from 780 nm to 894 nm can be used for a gas cell containing rubidium or cesium. This choice is dictated by the atomic composition of the gas cell. According to one embodiment, a collimating lens can be added in front of the laser diode to produce a non-divergent laser beam.

According to a standard embodiment, the light produced 112 by the laser 102 has a linear polarization and is attenuated by an absorbent neutral filter 104*a*. A different type of filter can be used in other embodiments. The presence of this filter is not necessary to the invention. A half-wave plate 104*b* can be used to modify the angle of the linear polarization of the laser source. In combination with the miniature cube 101, the half-wave plate 104*b* acts as a variable attenuator. In other embodiments, the use of the half-wave plate 104*b* can be omitted and the light intensity ratio between the beams transmitted and reflected by the cube 101 is adjusted by an appropriate orientation of the linear polarization axis of the light emitted by the laser relative to the splitter cube. A quarter-wave plate 105 is placed at the output of the cube against the face from which the laser beam deflected by the splitter 101 leaves, or at a right angle to the beam incident to the cube. The rapid axis of the quarter-wave plate 105 is oriented so that the incident linear polarization 113 is modified to a circular polarization 114 according to a first direction of rotation. In other embodiments, the quarter-wave plate 105 is oriented so that the incident linear polarization 113 is modified to a circular polarization according to a direction of rotation that is the reverse of the first. The laser ray of circular polarization 114 passes through the gas cell 106 and reaches the mirror 107. The latter sends only part of the ray back and a portion of the ray passes through the mirror 107 to be directed toward the photodetector 109. According to a standard embodiment, the gas cell is made of glass-silicon-glass by MEMS (micro-electromechanical system) techniques with an internal volume of typically 1 $mm^3$ and filled with an absorbent medium of alkaline metal atomic vapor type (rubidium or cesium), and a mixture of buffer gas. According to a standard embodiment, the gas cell is filled with rubidium-87 and a mixture of nitrogen and argon as buffer gas. In other embodiments, other types of cells can be filled with different buffer gases. According to a particular embodiment, a cylindrical miniature cell can be used. According to another particular embodiment, the gas cell can be incorporated in the PBSC 101. The cell 106 can be filled with other types of alkaline metallic vapor (rubidium-85, natural rubidium, cesium-133 for example) and other types of buffer gas (Xe, Ne for example).

Figure 6:
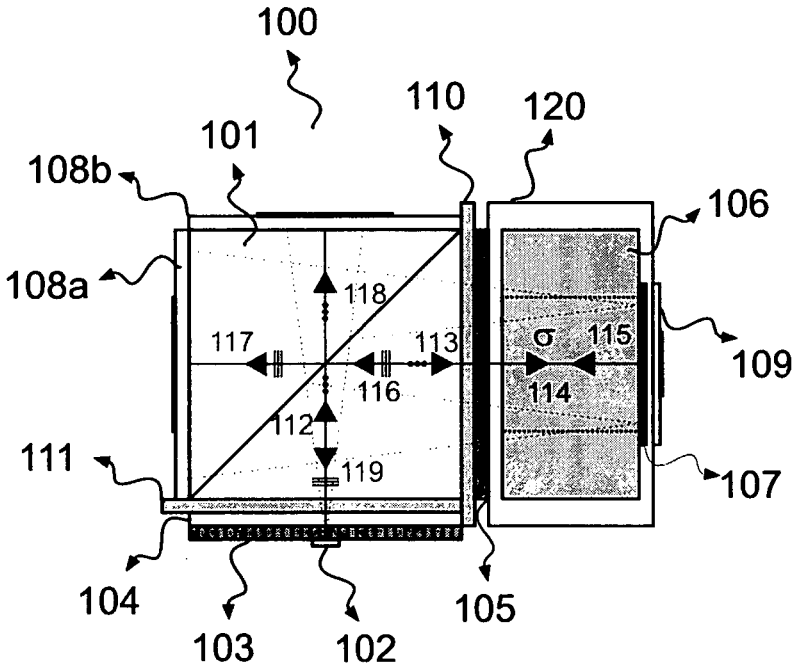
FIG. 6: is a schematic presentation according to the first embodiment with double passage of the design of the device of the invention based on the concept of the CPT atomic clock with right-angle geometry

FIG. 6 illustrates the design of a device that is particularly suited to the CPT clock according to the first embodiment. The teaching of this embodiment can be adapted to the production of other atomic clocks than that based on the diagram of the Raman oscillator (FIG. 1*b*). According to a standard embodiment (right-angle geometry), the splitting percentage of the splitter 101 is predefined so as to have a majority transmission and a minority reflection of approximately 90% and 10% (+/−10%) respectively.

After its interaction with the atoms of the alkaline metal vapor, the circularly polarized light beam 114 is mostly reflected by a mirror 107. In a standard CPT embodiment, the output window of the gas cell 106 is covered with metal (silver or gold, for example) to serve as reflector. In another embodiment, the coating of the output window of the gas cell 106 may be a dielectric mirror. The transmission of the reflector 107 is chosen such that a small portion of the light is transmitted toward the photodetector 109. The back-reflected light 115 passes through and interacts a second time with the atomic medium (double passage). At the cell output, the beam passes through the quarter-wave plate 105 which transforms its circular polarization into linear polarization 116, perpendicular to the transmission axis of the polarizer 103, and is mostly transmitted by the miniature splitter cube 101. This transmitted light beam 117 reaches the photodetector 108*a* which stores the absorption spectrum and, more specifically, the decrease in absorption due to the coherent population trapping process (CPT). In a standard CPT embodiment, the photodetector 108*a* is a silicon-type photodetector. In other CPT embodiments, different types of photodetectors can be used. The minority portion 119 of the beam 116 deflected by the splitter 101 is attenuated by the polarizer 103 and thus does not disturb the laser. The second photodetector 108*b* stores the light beam 118 initially transmitted by the miniature splitter cube 101. In this way, the output power of the laser diode 102 can be measured and set by a dedicated control loop. The diaphragms 110 and 111 are used to avoid any undesirable light from reaching the photodetectors if the size of the laser beam is greater than the dimensions of the faces of the miniature splitter cube 101. The light stored by the photodetector 109 situated after the mirror 107 can be used for different types of control such as frequency of the laser or temperature of the cell.

Figure 7:
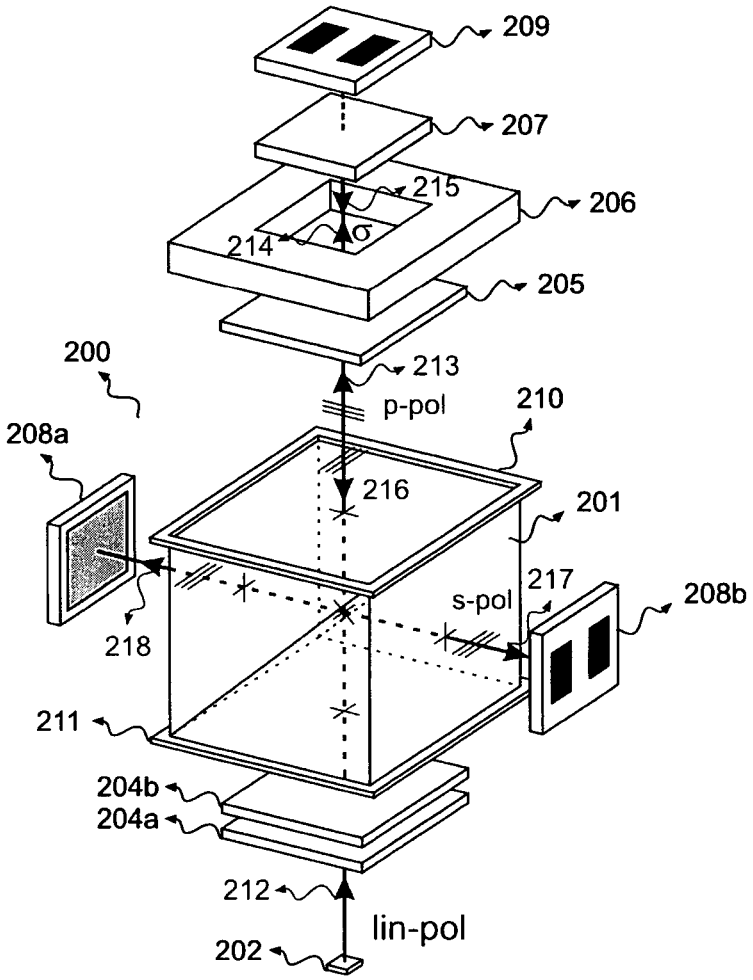
FIG. 7: is an exploded schematic presentation of the device of the invention based on the second embodiment with double passage and with a straight geometry

FIG. 7 illustrates a design with double optical passage based on the second embodiment, with a straight geometry 200 (the numeric coding begins at 200 for the design 200) which is very similar to the right-angle and double passage design 100 (see FIG. 5). The main difference compared to the design 100 lies in the position of the "gas cell 206, quarter-wave plate 205, semitransparent mirror 207 and photodetector 209" entity and of the photodetector 208*b*. In the model 200 of FIG. 7, the gas cell 206 is placed above the PBSC 201 and is therefore situated facing the laser 202. In this way, the light beam of polarization P 213 transmitted by the PBSC then modified into a beam of circular polarization by the quarter-wave plate 205 interacts with the atomic medium. The light beam of polarization S 217 is reflected by the PBSC 201 and the photodetector 208*b* placed at right angles is used to measure the laser power. These differences apart, the operating principle of the design 200 is the same as for the model 100.

Figure 8A:
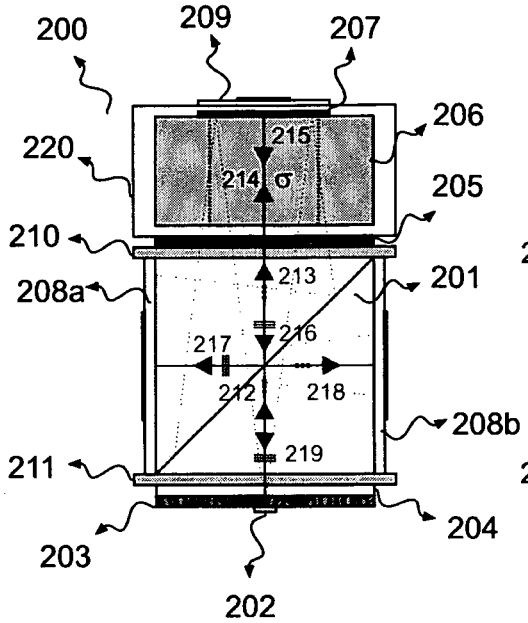
FIGS. 8*a* and 8*b*: are schematic presentations according to the first embodiment with double passage of the design of the device of the invention with straight geometry for the CPT atomic clock (8*a*) and the Raman oscillator (8*b*)

In FIG. 8*a* and according to a CPT embodiment with straight geometry according to the first embodiment, the splitting percentage of the splitter cube is pre-defined in a way that is the reverse of that described previously (right-angle module of FIG. 6), namely a minority transmission and a majority reflection of approximately 10% and 90% respectively (+/−10%). The double-passage and straight-geometry design that is thus obtained 200 (the numeric coding begins at 200 for the design 200) is very similar to the right-angle and double-passage design 100 (see FIG. 6). The role of the splitter 201 is thus reversed in order for the minority portion of the beam from the laser diode 202 to be transmitted rather than deflected. For its part, the back-reflected beam 216 is then mostly deflected toward the photodetector 208*a*. The main difference in the arrangement of the different elements compared to the design 100 lies in the position of the "gas cell 206, quarter-wave plate 205, semitransparent mirror 207 and photodetector 209" entity. In the model 200 of FIG. 8*a*, the gas cell entity is placed above the splitter cube 201 and is therefore situated facing the laser 202. The photodetector 208*b* is placed at right angles, where the light beam emitted by the laser 202 is reflected by the splitter cube 201 and is used to measure the laser power. These differences apart, the operating principle of the design 200 is the same as for the model 100.

Figure 8B:
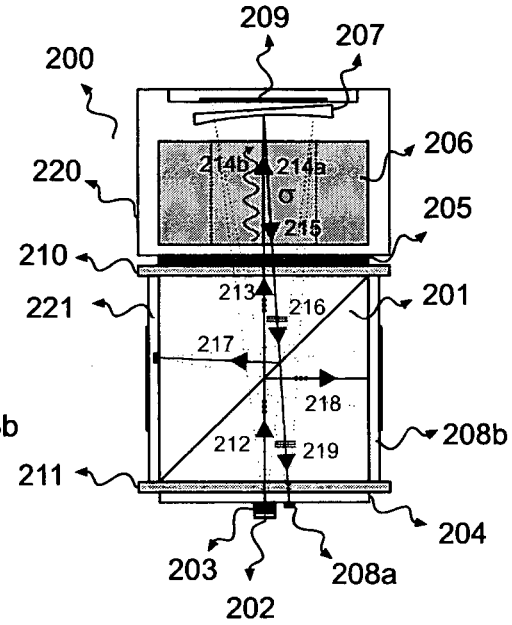

FIG. 8*b* illustrates the schematic representation of the straight-geometry module 200 with double passage of the embodiment of the Raman oscillator according to the first embodiment. All the numeric references correspond to the model 100 of the Raman embodiment and begin with "2" instead of "1". In the case of the Raman oscillator, the splitting percentage of the splitter cube is predefined in a way that is the reverse of that described above (CPT atomic clock of FIG. 8*a*), namely a minority reflection and a majority transmission of approximately 2% and 98% respectively (+/−2%).

Figure 9:
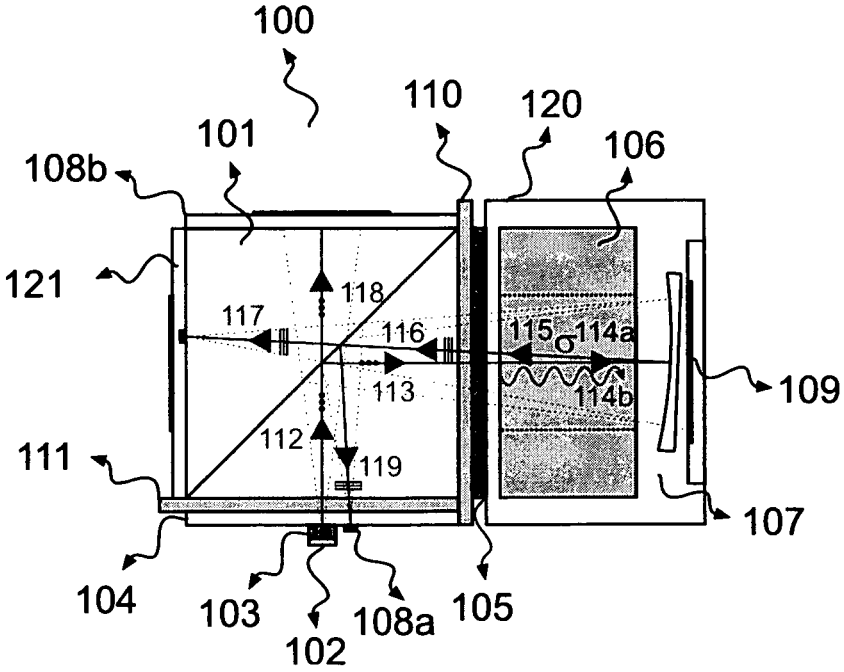
FIG. 9: is a schematic presentation according to the first embodiment with double passage of the design of the device of the invention based on the concept of the Raman oscillator with right-angle geometry

FIG. 9 illustrates a device that is particularly suited to a Raman oscillator according to the first embodiment and right-angle geometry. The splitting percentage of the splitter 101 is predefined so as to have a minority transmission and a majority reflection of approximately 2% and 98% respectively (+/−2%). After its interaction with the atoms of the alkali metal vapor, the incident light beam 114*a* and the light beam generated by the stimulated Raman scattering (called Raman beam) 114*b* are reflected by a mirror 107. In a standard Raman embodiment, the mirror 107 is coated with silver, it is inclined (typically by 2 to 20 degrees) and/or off-center relative to its axis of symmetry and the axis defined by the incident laser beam and is concave with a focal length chosen to focus the back-reflected light beams 115 (incident and Raman beams) on the photodetector 108*a*. The mirror 107 has a typical transmission of a few percent. These percentages of transmitted light reaching the surface of the photodetector 109 are used to measure the absorption spectrum and to stabilize the optical frequency of the laser. In a different Raman embodiment, the output window of the gas cell 106 is concave, coated with silver (or another metal such as gold for example) and acts as reflector. In other embodiments, the coating of the output window of the mirror can be done with dielectric layers.

The back-reflected light beams 115 (incident and Raman) pass through and interact a second time with the atomic medium (double passage). The quarter-wave plate 105 transforms these circularly polarized light beams into light beams of linear polarization 116. These light beams are mostly deflected 119 (incident and Raman) and reach the first photodetector 108*a* which stores the frequency beat between the incident beam and the Raman beam. In a standard Raman embodiment, the first photodetector 108*a* is a photodetector of high-speed semiconductor type (silicon or gallium arsenide) which is positioned at the focus of the concave mirror 107.

In other Raman embodiments, different types of high-speed photodetectors can be used. The second photodetector 108*b* stores the light 118 originating directly from the laser 102 and initially transmitted by the miniature splitter cube 101. In this way, the output power of the laser diode 102 can be measured and set by a dedicated control loop. Optionally, the photodetector 121 stores the back-reflected beam 117 transmitted by the splitter 101. The diaphragms 110 and 111 are used to prevent any undesirable light from reaching the photodetectors if their dimensions are greater than those of the miniature splitter cube 101.

Figure 10:
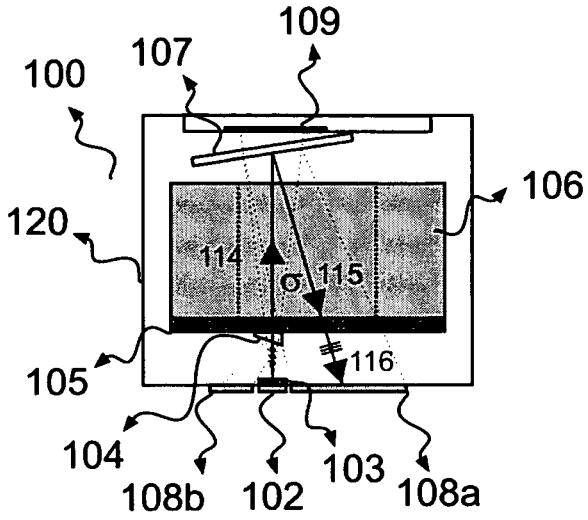
FIG. 10: is a schematic presentation according to the third embodiment with double passage of the design of the device of the invention based on the concept of the CPT atomic clock without splitter cube placed between the laser source and the cell
Figure 11:
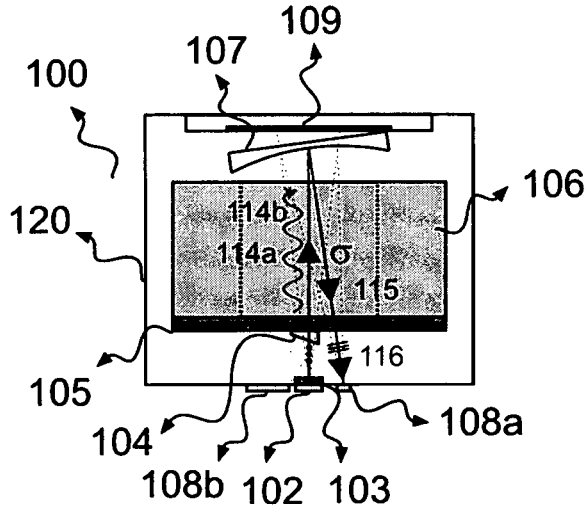
FIG. 11: is a schematic presentation according to the third embodiment with double passage of the design of the device of the invention based on the concept of the Raman oscillator without splitter cube placed between the laser source and the cell.

FIGS. 10 and 11 illustrate the third embodiment for the CPT atomic clock and the Raman oscillator, respectively, and which is not based on a splitter cube, but on a simple double-passage geometry. The light emitted by the laser source is linearly polarized, converted into circular polarization by a quarter-wave plate 105 before passage in the cell, reflection on the mirror, second passage in the cell, and detection on a photodetector 108*a*. The mirror 107 is semitransparent, with a second photodetector 109 placed behind the mirror.

It is the use of the semitransparent mirror 107 which allows for the detection of the light having interacted with the atoms of the cell by the photodetector 109. This detection by a second photodetector is particularly favorable in the case of a use of the device based on a Raman oscillator. In the case of a Raman oscillator, the photodetector 108*a* has a very narrow bandwidth centered around the resonant frequency of the atoms in order to maximize its signal detection effectiveness. The high atomic resonance frequency (typically >1 GHz) results in having a photodetector of small size. This specification is not compatible with a detection of the signal having interacted with the atoms of the cell to adjust the optical frequency of the laser on the resonance peak, or to adjust the temperature of the cell. In that case, a low cut-off frequency (typically <100 kHz), even DC operation, are indicated. It is therefore preferable to have two detectors, one used to detect the clock signal, the other to control the optical frequency of the laser and/or to control the temperature of the cell. The ideal means for producing this second detection of a signal having interacted with the atoms of the cell is to use a semitransparent mirror for the reflection and to place a photodetector 109 behind this mirror.

For the Raman oscillator, it is also advantageous for the mirror 107 to be of concave form as in FIG. 11, the concave form being intended to focus the reflected light beam on the photodetector 108*a*.

This arrangement is also advantageous for a clock based on a CPT principle, because the photodetector situated behind the semitransparent mirror can be used for the purposes of stabilizing the temperature of the cell containing the atoms or the frequency of the laser source.

To avoid having the beams backreflected by the mirror disturb the laser source 102, it is also advantageous to place a polarizer 103 in front of the laser source 102 and with a transmission axis parallel to the polarization of the beam emitted by the laser source 102.

Optionally, it is also possible to use the following elements:

- a neutral filter 104 placed between the laser source 102 and the quarter-wave plate 105 in order to adjust the power of the laser beam
- an inclined reflective filter 104 placed between the laser source 102 and the quarter-wave plate 105 in order to reflect a portion of the laser beam and adjust its power
- a third photodetector 108*b* placed in such a way as to store the light reflected by the inclined reflective filter 104 to control the optical power of the laser 102.

The invention claimed is:

1. A device for an atomic clock comprising:

a laser source generating a laser beam, a quarter-wave plate modifying the linear polarization of the laser beam into a circular polarization and vice versa, a gas cell passed through by the laser beam with circular polarization, a mirror sending the laser beam back toward the gas cell, a first photodetector, means for preventing the reflected beam from reaching the laser source, and a second photodetector, placed behind the mirror, said mirror being semitransparent and allowing a portion of the laser beam to pass, said second photodetector being used to control the optical frequency of the laser and/or to control the temperature of the cell, wherein the means for preventing the reflected beam from reaching the laser source comprise a splitter placed between the laser source and the mirror and being used to deflect and allow the laser beam to pass depending on the polarization of said beam in such a way that the polarization of the beam from the laser source via the splitter and arriving on the quarter-wave plate is linear according to the first angle and is modified by the quarter-wave plate into circular polarization, and so that the circular polarization of the beam reflected by the mirror and passing a second time through the gas cell is modified into linear polarization according to the second angle by the quarter-wave plate), the splitter directing the backreflected beam to the first photodetector.

2. The device as claimed in claim 1, wherein the mirror is of concave form, so as to focus the reflected light beam on the first photodetector.

3. The device as claimed in claim 1, wherein the mirror is of concave form and the axis of symmetry of which is off-center relative to that defined by the incident laser beam so as to focus the reflected light beam on the photodetector and prevent the reflected beam from reaching the laser source.

4. The device as claimed in claim 1, which comprises a third photodetector placed after the splitter so that a portion of the laser beam reaches said third photodetector without having passed through the gas cell.

5. The device as claimed in claim 1, which comprises a diaphragm placed between the splitter and the gas cell, this diaphragm reducing the size of the laser beam.

6. The device as claimed in claim 1, which comprises a second diaphragm placed between the splitter and the laser source, this diaphragm reducing the size of the laser beam.

7. The device as claimed in claim 4, which comprises a diaphragm placed between the splitter and the gas cell, this diaphragm reducing the size of the laser beam.

8. The device as claimed in claim 4, which comprises a second diaphragm placed between the splitter and the laser source, this diaphragm reducing the size of the laser beam.

9. The device as claimed in claim 5, which comprises a second diaphragm placed between the splitter and the laser source, this diaphragm reducing the size of the laser beam.

10. The device as claimed in claim 7, which comprises a second diaphragm placed between the splitter and the laser source, this diaphragm reducing the size of the laser beam.

11. A device for an atomic clock comprising:

a laser source generating a laser beam, a quarter-wave plate modifying the linear polarization of the laser beam into a circular polarization and vice versa, a gas cell passed through by the laser beam with circular polarization, a mirror sending the laser beam back toward the gas cell, a first photodetector, means for preventing the reflected beam from reaching the laser source, and a second photodetector, placed behind the mirror, said mirror being semitransparent and allowing a portion of the laser beam to pass, said second photodetector being used to control the optical frequency of the laser and/or to control the temperature of the cell, wherein the mirror is of concave form and the axis of symmetry of which is off-center relative to that defined by the incident laser beam so as to focus the reflected light beam on the photodetector and prevent the reflected beam from reaching the laser source.

12. The device as claimed in claim 11, which comprises a third photodetector placed after the splitter so that a portion of the laser beam reaches said third photodetector without having passed through the gas cell.

13. The device as claimed in claim 11, which comprises a diaphragm placed between the splitter and the gas cell, this diaphragm reducing the size of the laser beam.

14. The device as claimed in claim 11, which comprises a second diaphragm placed between the splitter and the laser source, this diaphragm reducing the size of the laser beam.

15. The device as claimed in claim 12, which comprises a diaphragm placed between the splitter and the gas cell, this diaphragm reducing the size of the laser beam.

16. The device as claimed in claim 12, which comprises a second diaphragm placed between the splitter and the laser source, this diaphragm reducing the size of the laser beam.

17. The device as claimed in claim 13, which comprises a second diaphragm placed between the splitter and the laser source, this diaphragm reducing the size of the laser beam.

18. The device as claimed in claim 15, which comprises a second diaphragm placed between the splitter and the laser source, this diaphragm reducing the size of the laser beam.

* * * * *